United States Patent [19]

VanTielen

[11] Patent Number: 4,590,449

[45] Date of Patent: May 20, 1986

[54] SOLENOID SWITCH

[76] Inventor: Willem R. VanTielen, 8891 Luce St., Oden, Mich. 49764

[21] Appl. No.: 639,704

[22] Filed: Aug. 13, 1984

[51] Int. Cl.[4] ..... H01H 67/02

[52] U.S. Cl. ..... 335/126; 335/131; 336/192

[58] Field of Search ..... 335/124, 126, 131, 151; 336/192

[56] References Cited

U.S. PATENT DOCUMENTS

| | | | |
|---|---|---|---|
| 2,516,304 | 7/1950 | Dickey . | |
| 2,553,517 | 5/1951 | Isserstedt | 335/126 X |
| 2,658,123 | 11/1953 | Stoeser | 335/124 |
| 2,775,742 | 12/1956 | Bogue et al. | 336/192 X |
| 2,933,573 | 4/1960 | Strider | 335/126 |
| 3,205,324 | 9/1965 | Driesch . | |
| 3,264,426 | 8/1966 | Place | 335/124 |
| 3,407,369 | 10/1968 | Hardesty . | |
| 3,940,726 | 2/1976 | Gershnow . | |
| 4,243,964 | 1/1981 | Bogner et al. . | |
| 4,342,973 | 8/1982 | Stone et al. . | |

*Primary Examiner*—George Harris

*Attorney, Agent, or Firm*—Price, Heneveld, Huizenga & Cooper

[57] ABSTRACT

A solenoid switch assembly adapted for use with internal combustion engine starter motors which includes a solenoid switch mounted within a housing such that the solenoid core reciprocates parallel to the electrical leads. The electrical leads are aligned with the solenoid core and extend from opposite sides of the housing to provide a generally "in-line" configuration. Preferably, the housing includes two interchangeable, mating housing sections. The solenoid switch elements are mounted within the housing without using individual fasteners for the separate elements.

30 Claims, 12 Drawing Figures

SOLENOID SWITCH

BACKGROUND OF THE INVENTION

The present invention relates to electrical switches and, in particular, to solenoid switches for use in internal combustion engine ignition systems for vehicles, lawn and garden equipment, and the like.

Solenoid switches are conventionally used with internal combustion engines to close the circuit between a battery and the starter motor during ignition. A typical solenoid switch includes an electrical coil in which a metal core is slidably received. The metal core acts as an actuator to shift a contact bridge when the coil is energized. The shifting of the metal core interconnects the contact bridge with two electrical contacts, one contact having a principal or major lead connected to the battery and the other contact having the other principal or major lead connected to the starter motor. Electrical power is supplied to the coil through separate smaller electrical leads which are connected to the battery and ignition switch.

In most solenoids, due to the orientation of the electrical contacts relative to the sliding core, the battery and starter motor leads extend to the side, i.e., perpendicular to the direction of travel of the core. This orientation is inconvenient, since it results in the solenoid switch assembly having electrical leads that extend at various angles from the side of the assembly housing. The solenoid assembly therefor cannot be easily mounted in confined spaces nor linearly between the battery and starter motor, since the solenoid assembly is uncentered or positioned off to one side of the electrical leads. The solenoid assembly must, therefore, be stationarily mounted in order to prevent the assembly from moving or flopping about. The variously extending leads make it especially difficult to mount the solenoid assembly in confined areas since all of the leads must be accessible.

Another difficulty associated with conventional solenoids is that the switch is made up of relatively small elements that require time consuming assembly. The various elements must each be individually secured within the solenoid containment housing by some type of fastener. This increases the cost of manufacturing and assembling these devices.

In addition, prior known solenoids have been relatively expensive to repair or replace. Further, the necessity for sustained reliability over long periods and in varying climatic conditions has previously kept the cost of conventional solenoids at a relatively high level.

SUMMARY OF THE INVENTION

The present invention solves the above noted problems by the provision of a highly reliable, inexpensive solenoid switch assembly that is substantially aligned with its major electrical connections or cables, i.e., "in-line" between a battery and starter motor in a typical installation. The invention permits the solenoid assembly to be linearly connected between the power source and the device to which power is supplied. As a result, the need to rigidly or stationarily mount the solenoid switch is, in many cases, obviated. Additionally, if the particular application does require stationary mounting of the solenoid assembly, mounting is relatively easy due to the aligned structure of the device.

Preferably, the solenoid switch assembly provides principal or major electrical leads which extend from the switch in opposite directions and which extend generally parallel to the direction of travel of the solenoid core. Both contacts are located on one side of the operative portion of the solenoid assembly, while the leads extend within the solenoid housing to opposite sides of the housing and are aligned with the axis of the moving core.

Additionally, the solenoid switch assembly is easily and inexpensively manufactured and includes a housing that is made up of two completely interchangeable sections. Further, the housing seals out water, dirt and other contaminants and maintains the various elements of the solenoid switch in their proper positions without requiring individual fastening of each element to the housing. Assembly of the elements is, therefore, relatively simple, while the cost of manufacture of the housing is greatly reduced due to the interchangeability of elements and ease of assembly.

Other features, objects or benefits of the invention will be recognized from the specification and drawings attached hereto.

DETAILED DESCRIPTION OF THE PREFERRED EMBODIMENT

Figure 1:
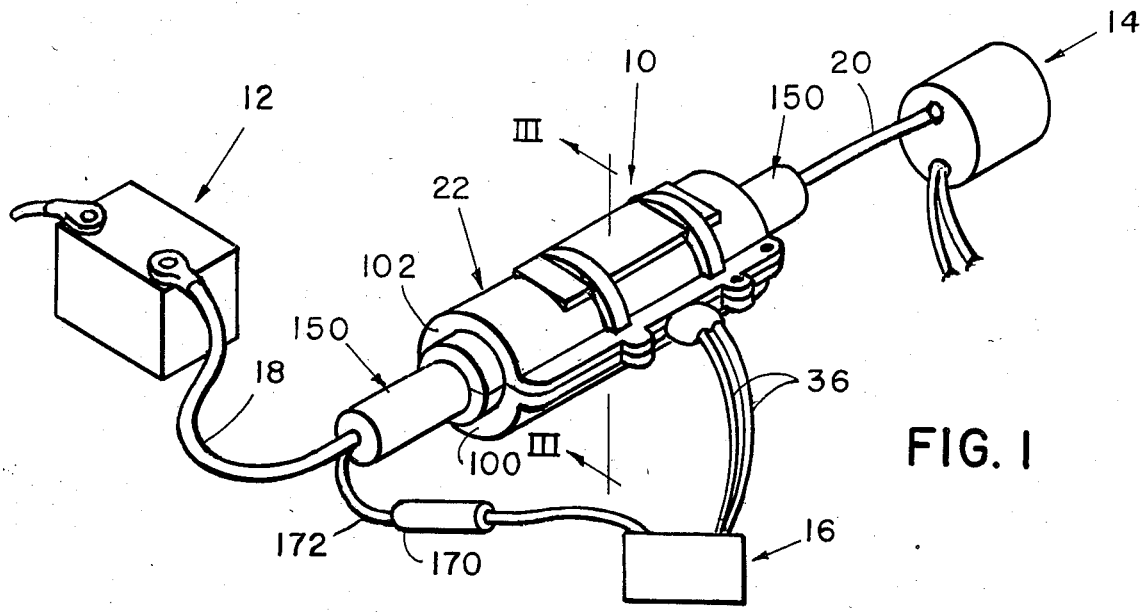
FIG. 1 is a perspective view of a solenoid switch assembly embodying the present invention shown connected in a circuit with a battery, a starter motor and ignition switch for an internal combustion engine.

The preferred embodiment is shown in FIG. 1 as an "in-line" solenoid switch assembly referenced generally as 10. Switch assembly 10 is connected linearly in a circuit between a battery or D.C. power source 12 and a conventional starter motor 14 for an internal combustion engine or other device to be powered. Solenoid switch 10 is also connected to an ignition switch 16.

Switch 16 is used to activate switch assembly 10 to close the circuit between battery 12 and starter motor 14.

Figures 2, 2A:
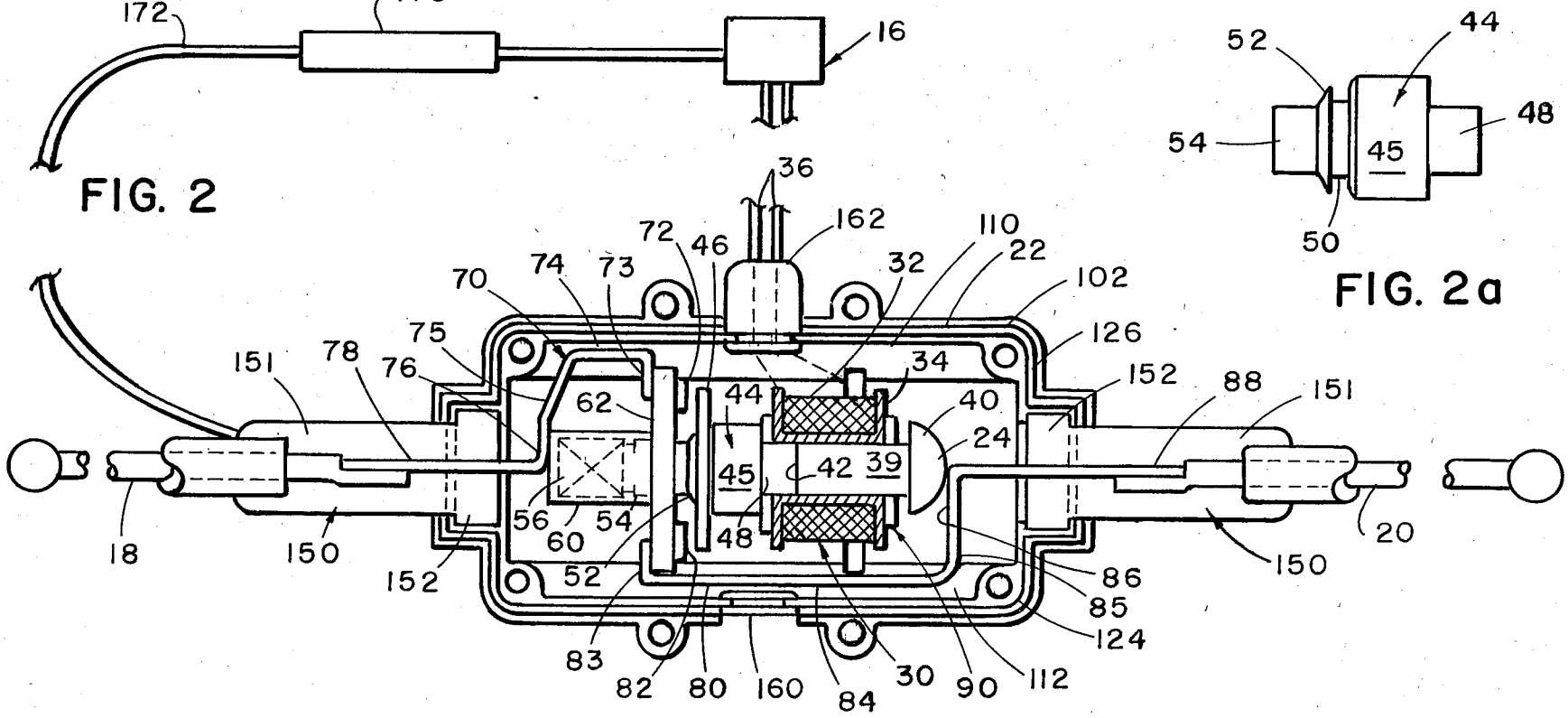
FIG. 2 is a plan view of the solenoid switch assembly of FIG. 1, shown with one-half of the housing removed and the solenoid coil shown in section.
FIG. 2*a* is a side elevation of the molded actuator used in assembly 10.

As shown in FIG. 2, switch assembly 10 includes a pair of electrical leads 18 and 20 respectively, which are aligned with one another and the movable core 24 of the assembly and extend from opposite sides of assembly 10. Switch assembly 10 includes an elongated housing 22, within which a solenoid core 24 moves along an axis generally parallel to electrical leads 18 and 20. Switch assembly 10, therefore, has an aligned "in-line" configuration which provides switch assembly 10 with the ability to be readily connected in a circuit.

Figure 3:
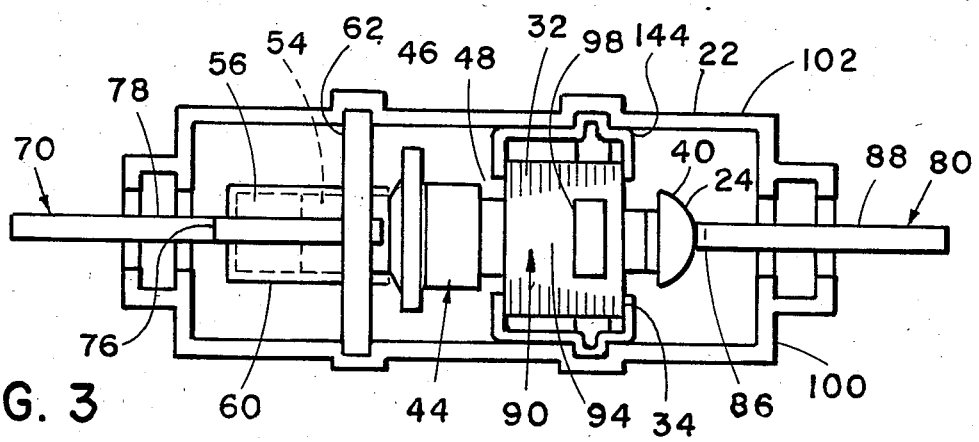
FIG. 3 is a fragmentary, sectional side view of the solenoid switch assembly taken along plane III—III of FIG. 1.
Figure 4:
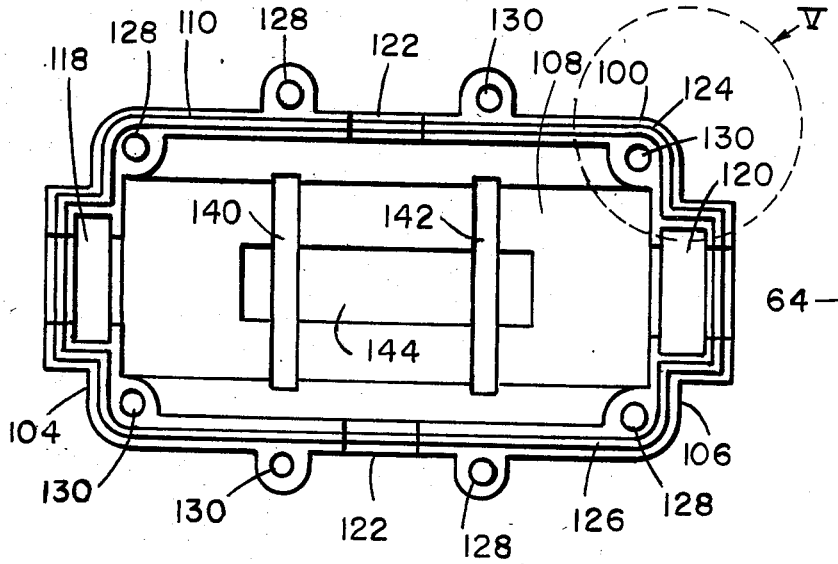
FIG. 4 is a plan view of one-half of the solenoid switch assembly housing section shown in FIG. 2 but with all solenoid parts removed.

As shown in FIGS. 2–4, switch assembly 10 includes a conventional solenoid coil 30 having copper wire windings 32 on a plastic bobbin 34. Coil 30 ranges between 3.8 ohms and 5.5 ohms, the specific value of which depends upon the solenoid assembly application. Windings 32 terminate in coil leads 36. Leads 36 connect coil 30 in a circuit with conventional ignition switch 16. Core 24 is slidably received within the central aperture of coil 30. Core 24 has a generally cylindrical body 39 with an enlarged, rounded head 40 that protrudes from coil 30. Core 24 terminates within coil 30 in a blunt engagement end 42 opposite enlarged head 40. Engagement end 42 engages and operatively shifts a solenoid actuator 44 when coil 30 is energized. Core 24 is a standard slug or rivet made of either 10.08 or 10.10 grade steel.

On actuator 44 a contact bridge 46 (FIGS. 2, 3) is mounted for closing the circuit of switch assembly 10. Contact bridge 46 is an electrically conductive, generally circular metal disk plate or ring having two flattened edges and a central aperture through which actuator 44 passes. Contact bridge 46 is preferably a copper disk pressed from sheet stock approximately 0.075 inches thick and 1.125 inches in diameter, with a central aperture approximately 0.499 inches in diameter.

Actuator 44 (FIG. 2*a*) includes a cylinder 45 approximately 0.625 inches in diameter and 0.388 inches long, and a blunt, cylindrical, coil protrusion 48 extending from one side of cylinder 45 that is slidably received within the aperture in coil 30. Coil protrusion 48 is approximately 0.375 inches in diameter and approximately 0.27 inches long. Coil protrusion 48 abuts engagement end 42 of core 24 in order to be shifted thereby. Extending from the face of actuator 44 opposite coil protrusion 48 is a bridge mounting cylinder 50. Mounting cylinder 50 is a short cylindrical protrusion slightly longer than the thickness of contact bridge 46 and is received through the central aperture of bridge 46. Mounting cylinder 50 is approximately 0.49 inches in diameter. At the outer perimeter of mounting cylinder 50 is a mounting lip 52 which has a diameter greater than that of the central aperture of contact bridge 46. Actuator 44 is an integrally molded polymeric element so that mounting lip 52 will resiliently deform and allow contact bridge 46 to be snapped over mounting lip 52 during assembly. A small amount of play is provided between contact bridge 46 and mounting cylinder 50. This small amount of play allows contact bridge 46 to seat itself properly during closing of the switch, as described below. Further, this play prevents contact bridge 46 from wearing excessively at one location by permitting some rotational movement of bridge 46 due to the electrical forces inherent in the operation of coil 32. Extending from mounting cylinder 50 opposite coil protrusion 48 is a blunt cylindrical spring protrusion or post 54. Protrusion 54 is used in the return of actuator 44 by engagement with a return spring 56 and is approximately 0.375 inches in diameter and 0.282 inches long. Actuator 44 is preferably molded from a non-ferro magnetic, non-electrically conducting, insulating, poly-propylene material which avoids interference with the operation of coil 32 and core 24, although other materials may alternatively be used that will provide proper electrical insulation and the required snap-mounting action for mounting lip 52.

Spring protrusion 54 is slidably received in a spring housing 60. Housing 60 is a closed cylindrical tube in which return spring 56 is seated. Spring protrusion 54 is slidably received in the central opening of housing 60 in order to engage spring 56. Spring 56 normally biases actuator 44 away from housing 60 and toward coil 30. The force of spring 56 is determined by the size and strength of the solenoid switch required for a given application, but this force preferably ranges between eighty and one hundred sixty grams. Actuator 44 is mounted with assembly housing 22 and held in alignment by the reception of spring protrusion 54 in housing 60 and coil protrusion 48 within coil 30.

Figure 11:
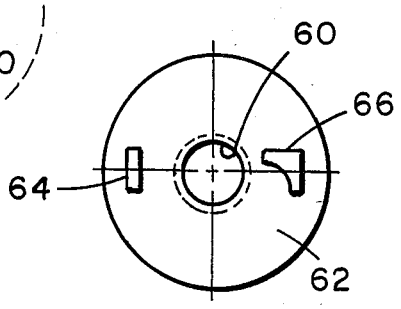
FIG. 11 is a schematic diagram of the electrical circuit for the assembly shown in FIG. 1.

Formed in one piece with and extending radially outwardly about the open end of spring housing 60 immediately adjacent bridge mounting cylinder 50 is an annular flange that forms a stationary contact mounting plate 62 (FIGS. 2, 3 and 11). Contact mounting plate 62 has a diameter greater than the diameter of contact bridge 46, preferably a diameter of approximately 1.418 inches, and locates spring housing 60 within assembly housing 22 as described below. As shown in FIG. 11, plate 62 includes two diametrically opposed slots, 64 and 66 which are used to mount the electrical contacts for solenoid assembly 10. Slot 64 is a rectangular slot spaced to one side of the opening for spring housing 60. Slot 66 is generally "L" shaped, with a triangular notch cut between the legs of the "L". This triangular notch assists in the mounting of a contact within slot 66, also as described below. Plate 62 and spring housing 60 are preferably molded from a non-electrically conductive, insulating polymeric material.

Passing through notch 66 is an electrical contact 70, FIGS. 2 and 3. Contact 70 is bent into a flat contact end 72 which extends radially inwardly toward spring protrusion 54 and provides a flat contact surface adjacent contact bridge 46. Contact 70 includes a length 73 which extends radially outwardly from contact end 72 on the opposite side of plate 62. A length 74 of contact 70 extends away from coil 30 and from the end of length 73, generally parallel to the axis of travel of core 24. From length 74 contact 70 forms a radially inward bend 75 that extends to the axis of travel of core 24. Bend 75 abuts and forms a stop 76 for spring housing 60. Inward bend 75 joins a connection end 78 which extends away from coil 30 and is both parallel and aligned with the axis of travel of core 24. Connection end 78 of contact 70 is welded to electrical lead 18. Preferably, contact end 72 is approximately 0.297 inches long, length 73 approximately 0.241 inches long, bend 74 extends radially inwardly 0.785 inches, and connection end 78 is approximately 1.094 inches long.

A second electrical contact 80 is mounted through contact mounting plate 62 in slot 66, FIGS. 2 and 3. Contact 80 is also bent radially inward to form a contact end 82. Contact end 82 provides a flat contact surface for contact bridge 46. Contact 80 extends through plate 62 and radially outwardly a short distance 83 sufficient to clear the outer edge of contact mounting plate 62.

Contact 80 then extends from length 83 rectilinearly past plate 62 and coil 30 in a length 84 which is parallel to the axis of core 24. Length 84 extends past the end of coil 30 and forms a bend 85 which extends radially inwardly into the axis of core 24. Bend 85 forms a stop 86 for core 24 at the outer most point of travel of core 24. Contact 80 also includes a connection end 88 which extends away from coil 30 both parallel to and aligned with connection end 78 of contact 70. Connection end 88 is welded to electrical lead 20. Preferably, contact end 82 is also approximately 0.297 inches long, length 83 approximately 0.316 inches long, length 84 approximately 2.08 inches long, bend 85 extends radially inwardly approximately 0.86 inches, and connection end 88 is approximately 1.25 inches long.

A metal coil mounting bracket 90 is used to mount coil 30 within housing 22, as shown in FIGS. 2, 3, and 6–8. Bracket 90 includes two halves that each have an end 92 which extend along one end of non-electrically conductive, insulating bobbin 34 formed from polymeric material. A pair of side brackets 94 extend to the other end of bobbin 34 and end flanges 95 clamp bobbin 34 in place against ends 92. On side brackets 94 adjacent ends 92 and 95 are curved seats 96 which receive bobbin 34. Actuator 44 passes between ends 92 to the inside of coil 30. Cylindrical body 39 of core 24 passes between end flanges 95. A pair of mounting flanges 98 extend radially outwardly from side brackets 94, FIGS. 6 and 7. Mounting flanges 98 are used in the mounting and locating of coil 30 within housing 32 as described below.

Figure 5:
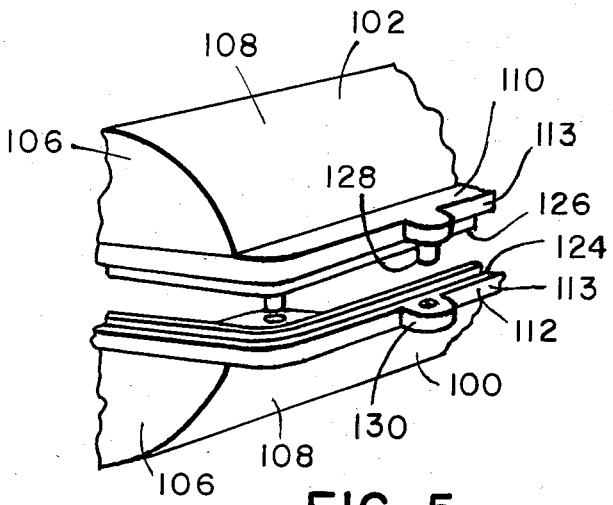
FIG. 5 is a fragmentary, perspective view of a pair of mating solenoid assembly housing sections shown at location V of FIG. 4.

As shown in FIGS. 1, 4 and 5, housing 22 includes two mating housing sections 100 and 102. Housing sections 100 and 102 are preferably molded from non-electrically conductive, insulating polymeric material having a high impact strength and high chemical and corrosion resistance. Sections 100, 102 each form one-half of housing 22 and are identical so as to be interchangeable and reversible. Therefore, only housing section 100 is described herein. As shown in FIGS. 4 and 5, housing section 100 includes a pair of spaced end walls 104, 106. End walls 104, 106 are joined by a side wall 108 that is curved such that when housing sections 100 and 102 are joined, housing 22 has an overall cylindrical configuration. Housing section 100 includes a pair of longitudinal edges 110, 112 which form planar flanges extending between end walls 104, 106. Edges 110 and 112 lie in the same plane and provide a means for joining housing sections 100 and 102.

Through either end wall 104 and 106 is a semi-circular cable recess 114, 116, respectively. Recesses 114, 116 mate with similar recesses on housing section 102 when housing 22 is assembled, thereby providing a circular aperture through end walls 104, 106. These cable recesses 114, 116 provide access to contact connection ends 78, 88. Protruding axially outwardly from each end wall 104 and 106 is an arcuate channel 118 and 120, respectively. Channels 118, 120 extend about recesses 114, 116 to provide a strain relief mounting chamber adjacent recesses 114 and 116 when housing sections 100 and 102 are joined. Channels 118 and 120 are, therefore, aligned with respect to each other.

Upstanding from each edge 110 and 112 is an edge wall 113 (FIG. 5). Edge walls 113 provide spacing between the planar surfaces of edges 110, 112 when housing sections 100 and 102 are joined together. Contact lengths 74 and 84 are, therefore, located between spaced edges 110 and 112 as shown in FIG. 2. At the midpoint of each longitudinal edge 110, 112 is a coil lead access recess 122 (FIGS. 2 and 4). Recesses 122 are oval in shape which provide an access opening to the interior of housing 22 for coil leads 36 when housing sections 100 and 102 are joined. Although only a single mating pair of recesses 122 are used for leads 36 when housing 22 is assembled, recesses 122 are provided on either side in order to provide interchangeability of sections 100, 102. The unused mating recesses 122 are blocked off during assembly as described below.

Extending along longitudinal edge 110 is a rectangular channel 124 (FIGS. 4 and 5) that is used in joining housing sections 100, 102. Channel 124 extends along the entire length of edge 110 and continues along the corresponding one side of end walls 104, 106 and arcuate channels 118, 120. Upstanding from longitudinal edge 112 is a rectangular tongue or flange 126 that is configured for mating reception in channel 124 to help secure the housing sections together and seal out water, dirt or other contaminants. Flange 126, therefore, extends the length of edge 112 as well as along the corresponding one side of end walls 104, 106 and arcuate channels 118, 120. Spaced about the perimeter of housing section 100 are four upstanding posts 128. Spaced about the perimeter of section 100 at locations complimentary to posts 128 are four joining apertures 130, which are located to correspond to posts 128 on housing section 102. Due to the complimentary positioning of channels 124 and flanges 126 and posts 128 and joining apertures 130, housing sections 100 and 102 are interchangeable. When housing sections 100 and 102 are mated together, sections 100 and 102 are joined either by an adhesive or by melting and welding posts 128 within joining apertures 130. Such adhesive aids the sealing function provided by channel 124 and flanges 126.

As shown in FIG. 4, located toward end wall 104 from access recesses 122 is a circumferential groove 140 that extends about the inner periphery of side wall 108. Spaced toward end wall 106 from access recesses 122 is another circumferential groove 142 identical to groove 140. Grooves 140 and 142 have a width sufficient for snug reception of contact mounting plate 62 therein. A rectangular channel 144 extends longitudinally along side wall 108 and extends past circumferential grooves 140 and 142 towards side walls 104 and 106. Channel 144 has a width and depth sufficient to receive a side bracket 94 on mounting bracket 90. Grooves 140, 142 and channel 144 are used in the mounting of the separate solenoid elements within housing 22.

As shown in FIG. 3, when mounting plate 62 is received in groove 140 and housing sections 100 and 102 are joined together, mounting plate 62 is fixed in position within housing 22. Mounting bracket 90 is positioned by circumferential groove 142 which receives mounting flange 98 and channel 144 which receives side bracket 94. One side bracket 94 is received in each channel 144 while mounting flanges 98 are matingly received in grooves 142. Similarly, when bracket 90 is positioned in grooves 142 and channels 144 and housing sections 100 and 102 are joined together, coil 30 is fixed within housing 22. Since actuator 44 is both positioned and aligned by spring housing 60 and coil 30, actuator 44 is also mounted in position within housing 22. Likewise, lengths 74, 84 of contacts 70, 80 are retained between the inside surfaces of edges 110, 112.

As shown in FIG. 2, a rubber strain relief element 150 is mounted in each channel 118. Strain relief element 150 relieves tension on the electrical contacts extending out of housing assembly 22 and includes a cylindrical body 151 and an enlarged end 152 that is encased within channel 118 when housing sections 100, 102 are joined. Strain relief 150 includes an aperture therethrough, through which extends the appropriate contact connecting end and electrical lead.

Figure 9:
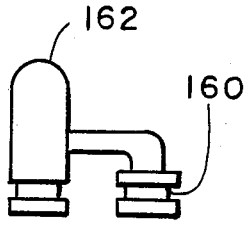
FIG. 9 is an elevation of a housing access aperture plug and a coil lead plug as molded in a joined condition prior to assembly.
Figure 6:
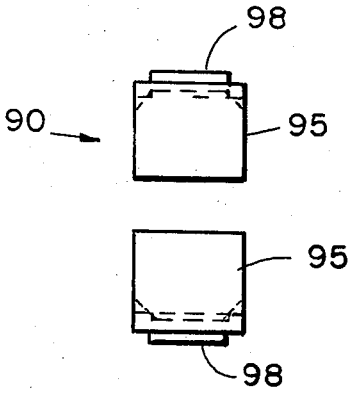
FIG. 6 is an end elevation of a mounting bracket element used in mounting the coil of the solenoid switch assembly.
Figure 7:
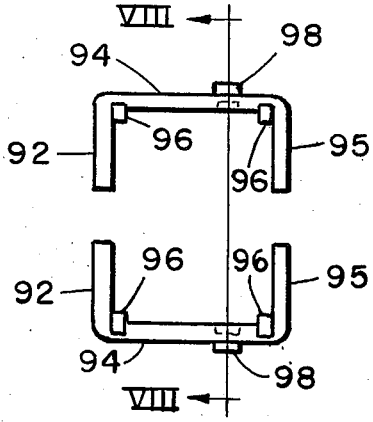
FIG. 7 is a side elevation of the mounting bracket element of FIG. 6.
Figure 8:
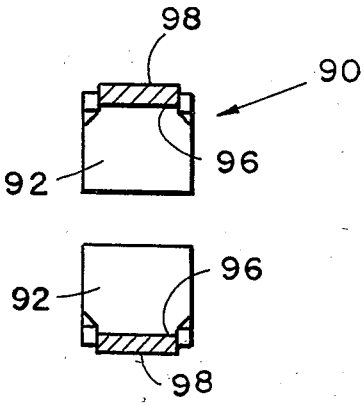
FIG. 8 is a sectional end elevation of the mounting bracket element taken along plane VIII—VIII of FIG. 7.
Figure 10:
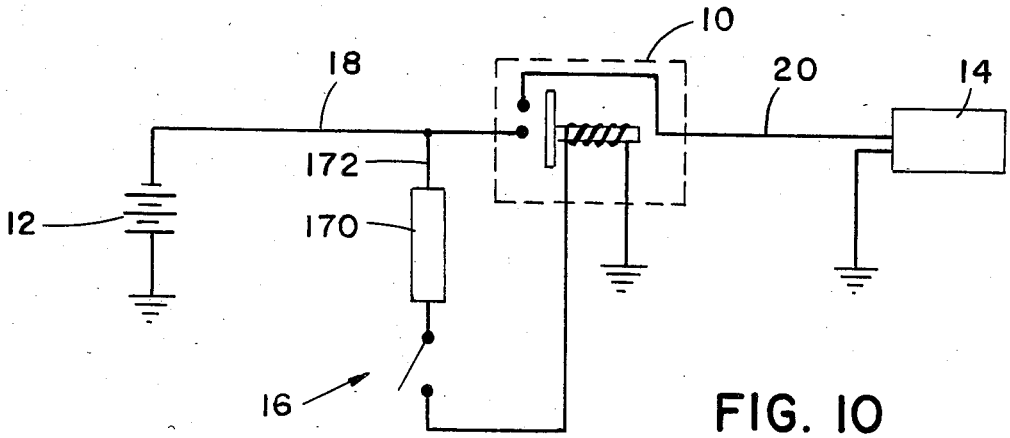
FIG. 10 is an end elevation of a mounting element for the stationary electrical contacts and solenoid return spring.

Shown in FIG. 2 is an access aperture plug 160. Plug 160 is oval in shape and includes an annular groove that permits plug 160 to be seated within mating recesses 122. A coil lead plug 162 has a generally oval cross section and an annular groove which provides for mounting in the pair of mating recesses 122 from those receiving plug 160. Lead plug 162 includes an aperture through which leads 36 extend. As shown in FIG. 9, during manufacture plugs 160 and 162 are molded together preferably from rubber or a soft pliable polymeric material so that upon assembly of switch assembly 10, a complete set of plugs 160 and 162 are readily available.

As shown in FIGS. 1 and 2, a fuse 170 is located in a power supply lead 172 to ignition switch 16. Fuse 170 is a conventional fuse sufficient for protection of ignition switch 16.

ASSEMBLY AND OPERATION

In order to assemble solenoid switch 10, contacts 70 and 80 are inserted through contact mounting plate 62 on spring housing 60. Contact 80 may simply be inserted and pivoted through slot 64. Contact 70 however must be inserted into "L" shaped slot 66 in a twisted orientation relative to its final position. When contact end 72 is seated flush against the face of plate 62, contact 70 is twisted or rotated on an axis parallel to connection end 78. The triangular notch of slot 66 permits contact 70 to twist into the other leg of the "L" slot and stop 76 will be twisted into abutment with spring housing 60.

Strain relief elements 150 are fitted over electrical leads 18 and 20. Electrical leads 18 and 20 are then welded to connection ends 78 and 88. Simultaneously, power supply lead 172 is welded to electrical lead 18. Strain relief elements 150 are slid down over connection ends 78 and 88 and enlarged ends 152 on strain relief elements 150 are fitted into arcuate channels 118 and 120 on housing section 100.

Contact mounting plate 62 is fitted into circumferential groove 140 within side wall 108 and spring 56 is seated within spring housing 60. Contact bridge 46 is snapped over mounting cylinder 50. Coil 30 is clamped within mounting bracket 90 while electrical leads 36 are fed through lead plug 162. Actuator 44 is slid into engagement with spring 56 within housing 60 and within coil 30. Core 24 is slid into the opposite end of coil 30 to abut coil protrusion 48 on actuator 44. Mounting flanges 98 on bracket 90 are then pressed into circumferential groove 142 while side bracket 94 is received in channel 144. Electrical lead plug 162 is forced into the recess 122 that is not blocked by contact 80, while aperture plug 160 is forced into the opposite recess 122. While the elements are held in this position, housing section 102 is mated onto housing section 100 and flanges 126 are inserted in channels 124 and joining posts 128 are secured within joining apertures 130.

It will be noted from the above that no individual fasteners are required to hold the separate elements within housing 22. Additionally, since the location and dimensions of circumferential grooves 140 and 142 are identical, the orientation of housing 100 does not effect the assembly of solenoid switch assembly 10.

Solenoid switch assembly operates in a manner identical to conventional solenoids with the exception of its aligned, "in-line" configuration. When ignition switch 16 is closed, power is applied through fuse 170 to coil 32. The electro magnetism in the coil draws core 24 inwardly, forcing actuator 44 to the left in FIG. 2 and engaging contact bridge 46 across contact ends 72, 82. Such contact completes the circuit between the battery 12 and starter 14. Release of ignition switch 16 de-energizes coil 32 allowing spring 56 to urge actuator 44 and core 24 to the right in FIG. 2 thereby breaking the contact between ends 72, 82 and de-energizing starter 14 after the engine is started. Core 24 travels in a direction parallel to electrical leads 18 and 20, so that solenoid 10 can simply replace a short section of cable. Solenoid switch assembly 10 is therefore easily mounted within a vehicle, lawn and garden equipment, or the like and does not require fixed mounting other than by way of connection of leads 18 and 20.

Although in the preferred embodiment the travel of core 24 and leads 18 and 20 are both parallel and aligned, alternatively leads 18 and 20 may be slightly off-set from the axis of travel of core 24. Solenoid switch assembly 10 in such an alternative configuration will still be aligned overall, although solenoid switch assembly 10 will be oriented slightly askew between leads 18 and 20.

It is to be recognized that the above is merely a description of the preferred embodiment and that one skilled in the art will understand that various modifications or improvements can be made without departing from the spirit of the invention disclosed herein. The scope of protection afforded is to be determined by the claims which follow and the breadth of interpretation which the law allows.

The embodiments of the invention in which an exclusive property or privilege is claimed are as follows.

1. A solenoid switch assembly comprising:
   a solenoid switch having a coil and a moving core, said core moving along an axis and being provided with an electrically conductive contact bridge movable with said core between an open position and a closed position;
   a first contact having a first contact end positioned to be engaged by said contact bridge in said closed position and having a first connection end extending generally along said axis on a first side of said solenoid switch; and
   a second contact having a second contact end positioned to be engaged by said contact bridge in said closed position and having a second connection end extending generally along said axis on a second side of said solenoid switch opposite said first side, whereby said solenoid switch assembly is provided with a generally aligned configuration.
2. The solenoid assembly of claim 1, wherein:
   said first and second contact ends are located on said first side of said switch and are spaced from said axis;
   said first contact extends away from said second side and extends radially inwardly to said first connection end; and
   said second contact extends from said second contact end to said second side and extends radially inwardly to said second connection end.
3. The solenoid switch assembly of claim 2, wherein:

said second contact includes a second contact bend that extends radially inwardly to said axis, said second contact bend forming a core stop for said core, said core stop being located at the outermost end of the travel of said core.

4. The solenoid switch assembly of claim 3, wherein:

said contact bridge is mounted on a movable actuator, said actuator being non-electrically conductive and non-ferro magnetic and separate from said core; and said core operatively contacting said actuator to shift said actuator from an open position with said contact bridge out of contact with said first and second contacts ends to a closed position with said contact bridge in contact with said first and second contact ends.

5. The solenoid switch assembly of claim 4, wherein:

said actuator includes a bridge mounting element thereon; and said contact bridge is an electrically conductive, metallic plate snap mounted on said bridge mounting element.

6. The solenoid switch assembly of claim 5, further comprising:

a return spring positioned to bias said actuator from said closed position to said open position, said spring being mounted in a spring housing; and said first contact including a first contact bend extending radially inwardly to said axis, said first contact bend forming a spring housing stop in contact with said spring housing.

7. The solenoid switch assembly of claim 6, wherein:

said second contact extends from said second contact end through an insulative contact mounting plate, said second contact extending radially outwardly from said contact mounting plate and toward said second side.

8. The solenoid switch assembly of claim 1, wherein:

said contact bridge is mounted on a movable actuator, said actuator being non-conductive, non-ferro magnetic, and separate from said core; and said core operatively contacting said actuator to shift said actuator from an open position with said contact bridge out of contact with said first and second contact ends to a closed position with said contact bridge in contact with said first and second contact ends.

9. The solenoid switch assembly of claim 8, wherein:

said actuator includes a bridge mounting element thereon; and said contact bridge is an electrically conductive metallic plate snap mounted on said bridge mounting element.

10. The solenoid switch assembly of claim 3, further comprising:

a return spring positioned to bias said contact bridge from said closed position to said open position, said spring being mounted in a spring housing; and said first contact including a first contact bend extending radially inwardly to said axis, said first contact bend forming a spring housing stop in contact with said spring housing.

11. The solenoid switch assembly of claim 2, wherein:

said second contact extends from said second contact end through an insulative contact mounting plate, said second contact extending radially outwardly from said contact mounting plate and toward said second side.

12. A solenoid switch assembly comprising:

a housing having a first end and an opposite second end defining a chamber therebetween;

a solenoid switch mounted in said housing chamber and having a moving contact that moves between an open position and a closed position along an axis generally perpendicular to said first and second ends;

a first electrical lead extending generally perpendicular to and through said first end and providing a first stationary contact position to be engaged by said moving contact in said closed position; and a second electrical lead extending generally perpendicular to and through said second end and providing a second stationary contact positioned to be contacted by said moving contact in said closed position, whereby said solenoid switch assembly is provided with a generally aligned configuration.

13. The solenoid switch assembly of claim 12, wherein:

said solenoid switch includes a first side adjacent said housing first end and a second side adjacent said housing second end;

said first and second stationary contacts are located on said first side and are spaced from said axis;

said first electrical lead extends from said first end to said first stationary contact; and said second electrical lead extends from said second end to said solenoid first side and to said second stationary contact.

14. The solenoid switch assembly of claim 13, wherein:

said first electrical lead extends through said first end at said axis, extends radially outwardly adjacent said first end and then extends toward said first stationary contact; and said second electrical lead extends through said second end at said axis, extends radially outwardly adjacent said second end and extends toward said second stationary contact.

15. The solenoid switch assembly of claim 12, wherein:

said housing comprises two mating housing sections, said housing sections being interchangeable; and means for joining said sections.

16. The solenoid switch assembly of claim 15, wherein:

said first and second stationary contacts are mounted on an insulative contact mounting plate; and said housing sections include a first perimeter channel extending about the inner perimeter of said housing sections, said first perimeter channel configured to receive said contact mounting plate therein and fixedly mount said contact mounting plate between said mounting sections.

17. The solenoid switch assembly of claim 16, wherein:

said solenoid switch includes a coil and bracket means for mounting said coil, said bracket means extending along opposite sides of said coil generally parallel to said axis, and said bracket means including mounting flanges extending from opposite sides of said bracket means;

each said housing section includes a coil mounting bracket channel extending longitudinally therein, said bracket channel configured to receive one side of said bracket means therein; and each said housing section includes a mounting flange channel extending perpendicular to and communicative with said bracket channel, one of said mounting flanges being received in said mounting flange channel, whereby said bracket means is received in said bracket channels and said mounting flanges are received in said mounting flange channels when said housing sections are joined together to fixedly mount said coil within said housing.

18. The solenoid switch assembly of claim 17, wherein:

said mounting flange channels comprise a second perimeter channel extending about the inner perimeter of said housing sections at a location complimentary to said first perimeter channel such that said housing sections are interchangeable.

19. The solenoid switch assembly of claim 18, wherein:

said solenoid switch includes a solenoid core slidably received in said coil; and said moving contact is mounted upon an actuator slidably received between and aligned by said contact mounting plate and said coil, said core operatively contacting said actuator to shift said moving contact from said open position to said closed position.

20. The solenoid switch assembly of claim 19, wherein:

said actuator includes a moving contact mounting element thereon; and said moving contact is an electrically conductive metallic plate snap mounted on said moving contact mounting element.

21. The solenoid switch assembly of claim 15, wherein:

each said housing section includes a first longitudinal edge extending between said first end and said second end, said first longitudinal edge including a joining groove therealong; and each said housing section includes a second longitudinal edge extending between said first end and said second end, said second longitudinal edge including a joining flange upstanding therefrom, said joining flange shaped for mating reception in said first longitudinal edge joining groove.

22. The solenoid switch assembly of claim 21, wherein:

each of said first and second longitudinal edges includes a coil lead recess therein; and said housing includes a recess plug configured to be received in and block a mating pair of said coil lead recesses when said housing sections are joined.

23. A housing for a solenoid switch assembly, comprising:

a pair of spaced end walls, each end wall having an electrical lead aperture therethrough;

a side wall joining said end walls so as to define a solenoid switch chamber therebetween;

cable mounting means for mounting an electrical cable on each said end wall such that each cable is communicative with the corresponding one of said electrical lead apertures; and means for orienting and mounting a solenoid switch in said chamber such that the core of said solenoid switch moves generally perpendicular to said end walls.

24. The housing of claim 23, wherein:

said housing comprises two mating housing sections, said sections being interchangeable; and means for joining said sections.

25. The housing of claim 24, wherein:

said joining means comprises each said housing section having a first longitudinal edge along said side wall, said first longitudinal edge including a joining groove therein, and each said section having a second longitudinal edge along said side wall, said second longitudinal edge including an upstanding joining flange thereon shaped for mating reception in said joining groove.

26. The housing of claim 25, wherein:

said joining means comprises a plurality of posts and a plurality of joining apertures complimentarily positioned on said first and second edges, such that said posts are received in said joining apertures when said two housing sections are matingly joined together.

27. The housing of claim 24, wherein:

each said housing section has a first longitudinal edge along said side wall and a second longitudinal edge along said side wall;

each said first and second edge includes a coil lead access recess therein; and said housing includes a recess plug configured to be mounted between and block a mating pair of said coil lead access recesses when said housing sections are joined together.

28. The housing of claim 23, wherein:

said orienting means includes a first perimeter groove extending about the inner perimeter of said side wall, said first perimeter groove shaped for reception of a stationary contact mounting plate lying in a plane generally parallel to said end walls, and a pair of coil mounting channels in opposite sides of said side wall, said coil mounting channels extending generally perpendicular to said end walls.

29. The housing of claim 28, further comprising:

a second perimeter groove extending about the inner perimeter of said side wall, said second perimeter groove having a configuration identical to said first perimeter groove, and said second perimeter groove being positioned at a location complimentary to that of said first perimeter groove.

30. The housing of claim 23, wherein:

said cable mounting means includes an annular channel extending about each said electrical lead aperture.

* * * * *